United States Patent [19]

Smiltnieks et al.

[11] 4,193,338

[45] Mar. 18, 1980

[54] GAS DISPERSION SYSTEM

[76] Inventors: Varis Smiltnieks, 289 The Kingsway, Islington; Bernard C. Stonehill, 3554 Stonecreek Crescent, Mississauga, both of Ontario, Canada

[21] Appl. No.: 844,805

[22] Filed: Oct. 25, 1977

[30] Foreign Application Priority Data

Oct. 23, 1973 [CA] Canada ..... 238328

[51] Int. Cl.[2] ..... F27D 21/00; F24F 00/00; G21C 19/20

[52] U.S. Cl. ..... 98/1; 176/37

[58] Field of Search ..... 98/1; 176/37; 244/114 R, 114 B; 48/192; 432/42, 58, 219

[56] References Cited

U.S. PATENT DOCUMENTS

| | | | |
|---|---|---|---|
| 3,056,736 | 10/1962 | Went et al. | 176/37 |
| 3,113,915 | 12/1963 | Webb et al. | 176/37 |
| 3,227,061 | 1/1966 | Swayze | 98/1 |
| 3,496,033 | 2/1970 | Gilbreath et al. | 432/42 |
| 4,056,362 | 11/1977 | Gablin et al. | 176/37 |

*Primary Examiner*—Patrick D. Lawson
*Attorney, Agent, or Firm*—Ridout & Maybee

[57] ABSTRACT

A gas dispersion system for dispersing noxious gas released into the atmosphere within a contained ground area to prevent its passing at an unacceptable concentration to a neighboring ground area to be protected, comprising means responsive to the release of gas within the contained area for producing a trip signal, air heating means extending along a base region interposed between the contained area and the protected area, the air heating means being operable to produce an upward flow of heated air from the base region to form a buoyant plume of rising air for dispersing the gas upwards, and control means responsive to said trip signal for initiating operation of the air heating means.

6 Claims, 11 Drawing Figures

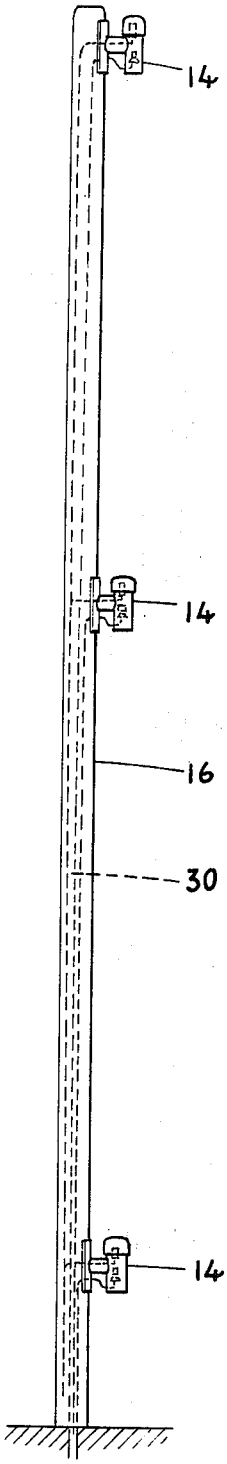
Fig. 6.
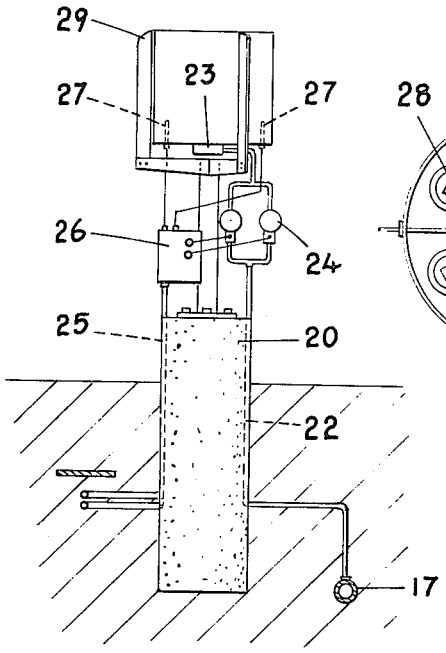
Fig. 4
Fig. 5.
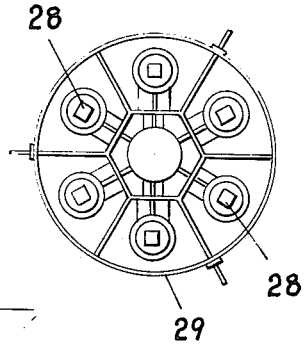
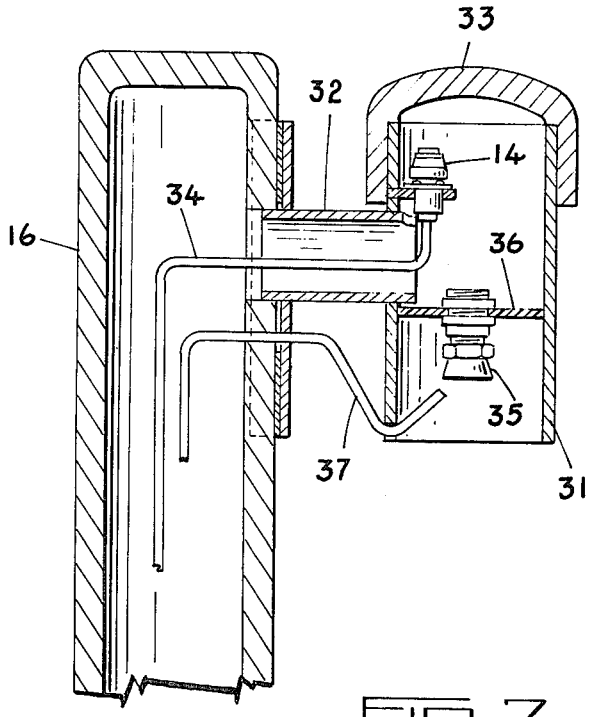
Fig. 7.

GAS DISPERSION SYSTEM

FIELD OF THE INVENTION

This invention relates to a gas dispersion system, intended to be used under emergency conditions, for dispersing noxious gases, vapors, fumes etc. which in exceptional circumstances might be released accidentally into the atmosphere in dangerous quantities. The system is primarily intended for use in association with an industrial plant in which a great quantity of a noxious gas may be stored under pressure or otherwise employed in an industrial process. A heavy water plant, for example, may have a number of processing towers in which hydrogen sulphide is employed; whereas every precaution is normally taken to minimize the risk of a serious gas leakage from such plant, the possible consequences of such a leakage from the standpoint of persons residing or working in neighboring areas, are so serious as to make it highly desirable to provide an emergency protective system which will automatically come into operation in the event of a serious accident.

SUMMARY OF THE INVENTION

It is an object of the present invention to provide such an emergency protective system which, in the event of a major gas leakage, will automatically produce a buoyant plume of rising air for dispersing the gas upwardly so as to prevent its passing at an unacceptable concentration to a neighbouring area.

Accordingly, the invention provides a gas dispersion system for dispersing noxious gas which may be released into the atmosphere within a contained ground area to prevent its passing at an unacceptable concentration to a neighbouring ground area to be protected. Essentially the system comprises means responsive to the release of gas within the contained area for producing a trip signal, air heating means extending along a base region interposed between the contained area and the protected area, the air heating means being operable to produce an upward flow of heated air from the base region to form a buoyant plume of rising air for dispersing the gas upwards, and control means responsive to said trip signal for initiating operation of the air heating means.

The air heating means may comprise a plurality of burners distributed along the base region, fuel supply means for the burners, and ignition means operable by the control means to ignite the burners thereby to produce the buoyant plume by thermal convection. The means for producing the trip signal may comprise a plurality of gas sensors positioned and arranged to intercept the flow of gas from the contained area towards the protected area. In the case of a system in which the noxious gas is normally contained under pressure, the means for producing the trip signal may, alternatively or in addition, include means responsive to a predetermined rate of fall of pressure of the contained gas.

BRIEF DESCRIPTION OF THE DRAWINGS

In order that the invention may be readily understood, one embodiment thereof will now be described, by way of example, with reference to the accompanying drawings, in which:

FIG. 4 illustrates one of the burners in more detail;

FIG. 5 is a plan view of the burner shown in FIG. 4;

FIG. 6 shows an arrangement of gas sensors mounted on a support tower;

FIG. 7 is an enlarged view of a detail of FIG. 6;

DESCRIPTION OF THE PREFERRED EMBODIMENT

Figure 1:
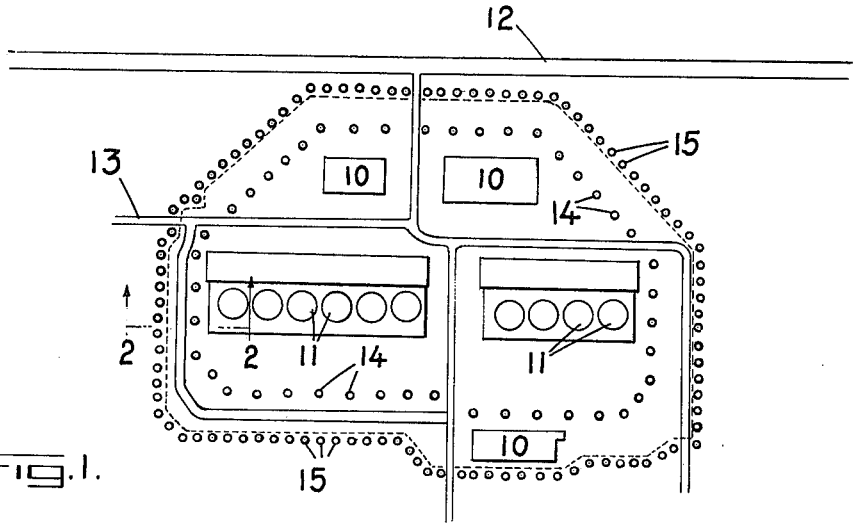
FIG. 1 is a diagrammatic plan view of a heavy water plant having a gas dispersion system according to the invention.

FIG. 1 illustrates in plan view the site of a heavy water plant. Plant buildings are indicated at 10, and process towers, in which hydrogen sulphide is contained under pressure, are indicated at 11. The area in which the process towers are located is referred to herein as the "contained area," while neighbouring areas which must be protected in the event of accidental release of gas into the atmosphere within the contained area are referred to herein as the "protected area." In the present example the contained area is wholly surrounded by the protected area. However, in certain cases, as for example when the plant site is adjacent an uninhabited area, it may be unnecessary to protect the whole of the area surrounding the plant, since any leakage of gas into such an uninhabited area would not have castastrophic consequences. FIG. 1 shows a road 12 passing through the protected area, with service roads 13 passing through the contained area.

The essential components of the gas dispersion system are means responsive to gas release for producing a trip signal, air heating means extending along a base region interposed between the contained area and the protected area, the air heating means being operable to produce an upward flow of heated air from the base region so as to form a buoyant plume for dispersing the gas upwards, and control means responsive to the trip signal for initiating operation of the air heating means. As shown in FIG. 1, a plurality of gas sensors 14 are distributed along a first base region enclosing the contained area, the gas sensors forming a detection screen and being positioned and arranged to intercept the flow of gas from the contained area towards the protected area. As will later be described, circuit means are coupled to the gas sensors for producing a warning signal in response to the detection of gas at above a certain concentration and for producing a trip signal in response to the detection of gas at a certain higher concentration. As will also later be described, circuit means are also provided for producing a trip signal in response to a predetermined rate of fall of gas pressure in any of the process towers. A plurality of propane burners 15 are distributed along a second base region interposed between the gas sensors and the protected area, the burners being so positioned and arranged that, when ignited, they produce by thermal convection an upward flow of air from an area extending along the entire length of the second base region.

Figure 2:
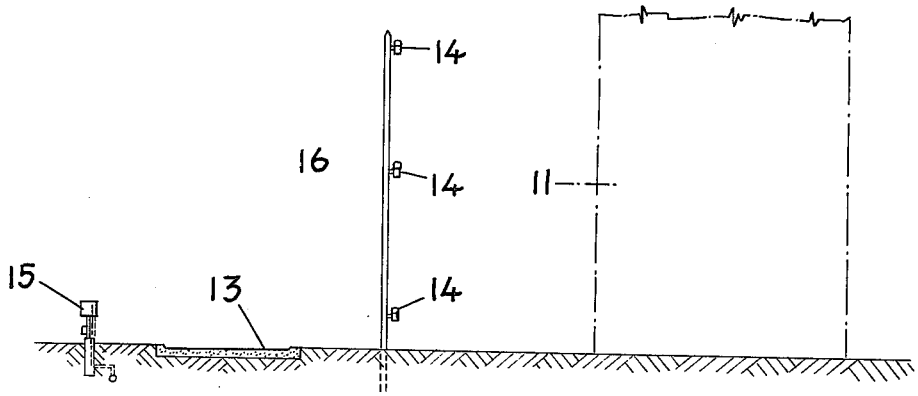
FIG. 2 is a vertical elevation on line 2—2 in FIG. 1, showing partly in section a detail of the gas dispersion system.

FIG. 2 shows part of one of the process towers 11, an assembly of gas sensors 14, and a burner 15. The gas sensors 14 are mounted on support towers 16 spaced along said "first base region," each support tower carrying a plurality of gas sensors mounted at different heights. The sensors can be commercial sensors of the metal oxide type, for example, although since these are not specific to hydrogen sulphide it may be necessary in some installations that the lowermost sensors on the columns be made specific to hydrogen sulphide, so as to avoid the risk of tripping the system in response to the passage of service trucks and the like. The burner 15, it will be noted, is spaced radially outwardly from the sensor support tower.

Figure 3:
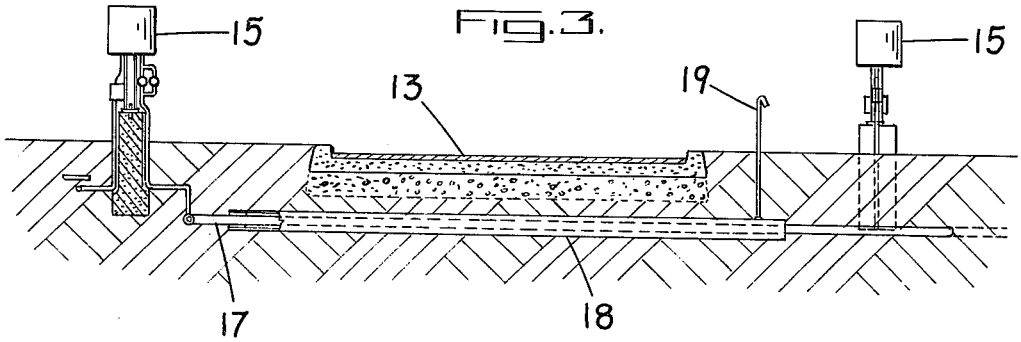
FIG. 3 shows two of the burners constituting part of the means for producing a buoyant plume of rising air.

FIG. 3 shows two burners 15 positioned one each side of a service road 13. The burners are supplied with propane from a main 17, which is shrouded by a pipe 18 where it passes under the road 13, the pipe having a vent 19. Details of a burner are shown in FIGS. 4 and 5. The burner is mounted on a support pillar 20, which is firmly mounted in a concrete foundation 21, and which, carries a pipe 22 for feeding propane to a burner hub manifold 23 from the fuel main 17. The supply of propane is controlled by solenoid valves 24. The pillar 20 also carries leads 25 to a power unit 26 for controlling the valves 24 and energizing the ignition electrodes 27. The burner has six nozzles 28 surrounding the hub manifold 23 to which they are connected, and shielded by a shield 29 of a cylindrical form supported on radial arms connected to the hub manifold 23.

FIG. 6 shows in more detail the gas sensors 14 mounted on a support tower 16, the latter being of hollow concrete construction and housing electrical leads 30 from the gas sensors to the electrical control system. The upper two sensors need not be sensitive to hydrogen sulphide exclusively, since experiments have shown that these will not be exposed to fumes from cars and trucks at road level. However, it may be necessary in some installations to guard against the response to such fumes from the lowermost sensors. This can be accomplished by making these sensors sensitive to hydrogen sulphide exclusively or providing pairs of sensors at different heights both sensors of a pair being required to trip before an alarm or trip signal is given. As shown in FIG. 7 an individual gas sensor 14 is mounted in a cylindrical housing 31 supported from the support tower 16 by a tubular arm 32. The housing 31 has a loose fitting cap 33. Electrical leads 34 from the gas sensor 14 pass through the tubular arm 32 into the support tower. Beneath the gas sensor a funnel 35 is mounted by means of a spider 36, and a gas pipe 37 terminates just beneath the funnel for the purpose of injecting hydrogen sulphide for calibration and test purposes.

Figure 8:
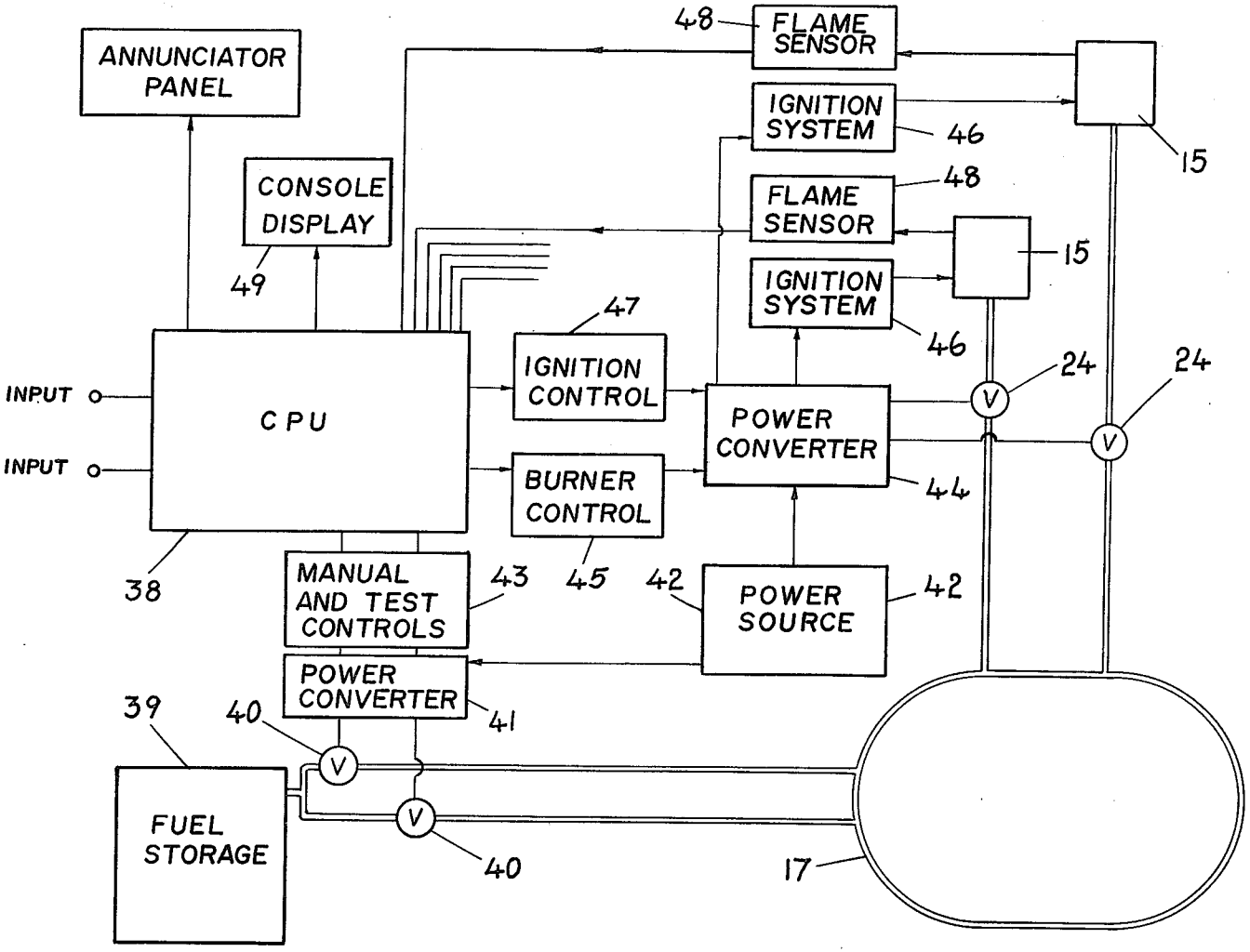
FIG. 8 is a schematic block diagram of the controls of the gas dispersion system.

Referring now to FIG. 8, signals responsive to the detection of a gas release within the contained area, either from the response of the gas sensors or from the detection of a predetermined rate of fall of pressure within a processing tower, are fed into a central processing unit 38. The propane burners 15, two of which are shown in the diagram, are fed from the gas manifold 17, which in turn is connected to a store of fuel 39 via valves 40, these valves being normally open so that the burner supply pipes will remain charged for immediate operation of the burners in an emergency. The valves 40 are operated from a power converter 41 connected to a power source 42, and are controlled manually from a unit indicated diagrammatically at 43. The burner valves 24 are also operated from a power convertor 44 connected to the power source 42, but these are opened automatically in response to a control signal from a burner control unit 45 under the control of the central processing unit 38. The ignition systems for the burners, indicated diagrammatically at 46, receive power from the power convertor 44 in accordance with a control signal from an ignition control unit 47 under the control of the central processing unit 38. The conditions of the burners are monitored by flame sensors 48, the central processing unit responds to the flame sensors to provide an appropriate display on a console display panel 49.

Figure 9:
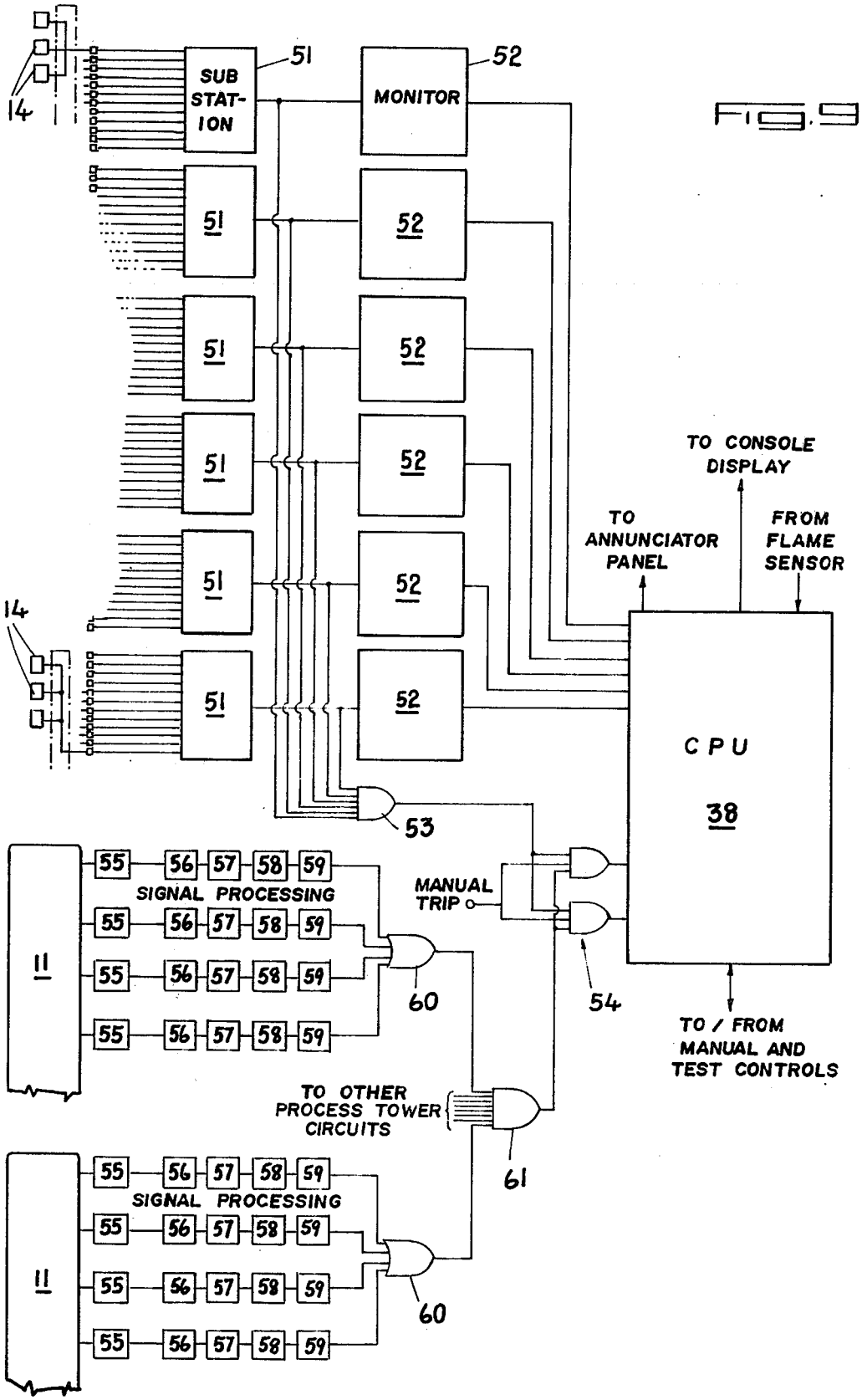
FIG. 9 is a schematic block diagram showing the routing of signals to the control unit thereof.

FIG. 9 illustrates the routing of signals to the central processing unit 38. The gas sensors 14 are mounted three to a support tower each tower having a respective termination box 50 to which the leads of its sensors pass. The termination boxes 50 are grouped in sets of from twelve to fourteen, the connections from each set being taken to a common substation 51; each substation is common to a set of adjacent sensor support towers covering a particular segment of the periphery of the contained area. Connected to the substations are monitoring circuits 52, which feed information relating to the groups of gas sensors to the central processing unit 38. The outputs of the substations 51 are taken to an OR gate 53, the output of which is in turn connected to the input of a second OR gate 54 for passing a trip signal to the central processing unit. It will be observed that the OR gate 54 has an input facility for tripping the system manually.

Now each of the process towers 11 is fitted with four pressure sensors 55 for monitoring the gas pressure therein. The pressure sensors are mounted at different heights. The analogue output of each pressure sensor 55 is taken to an analogue/digital converter 56, and thence to a differentiating circuit 57 for producing an output signal corresponding to the rate of change of any pressure condition. The latter output is taken to a comparator circuit 58 which yields an output signal onlyif the rate of change signal exceeds a predetermined threshold value; this output is taken via a time delay circuit 59 and thence to an AND gate 60 which is common to the signal conditioning circuits of the one processing tower. The purpose of AND-ing the responses from the four pressure sensors is to avoid spurious responses due to pressure movements within the tower. However, in cases where such pressure movements are not likely to cause problems, a greater sensitivity can be obtained by replacing the AND gates 60 by OR gates.

The outputs of the AND gates 60 are connected to the inputs of an OR gate 61, the output of which is connected to the OR gate 54. Thus the central processing unit 38 will respond to any one of the following conditions in the manner indicated:

(a) the detection of gas at a concentration above a first predetermined level, the result being to indicate on the console display panel which of the segments or segment in which the gas detection was made;

(b) the detection of gas at a concentration above a second, higher, predetermined level, the result being to initiate operation of all the burners;

(c) the detection of a predetermined rate of fall of gas pressure in any of the process towers, the result being to initiate operation of all the burners;

(d) the application of a manual trip signal, the result being to initiate operation of all the burners.

Figure 10:
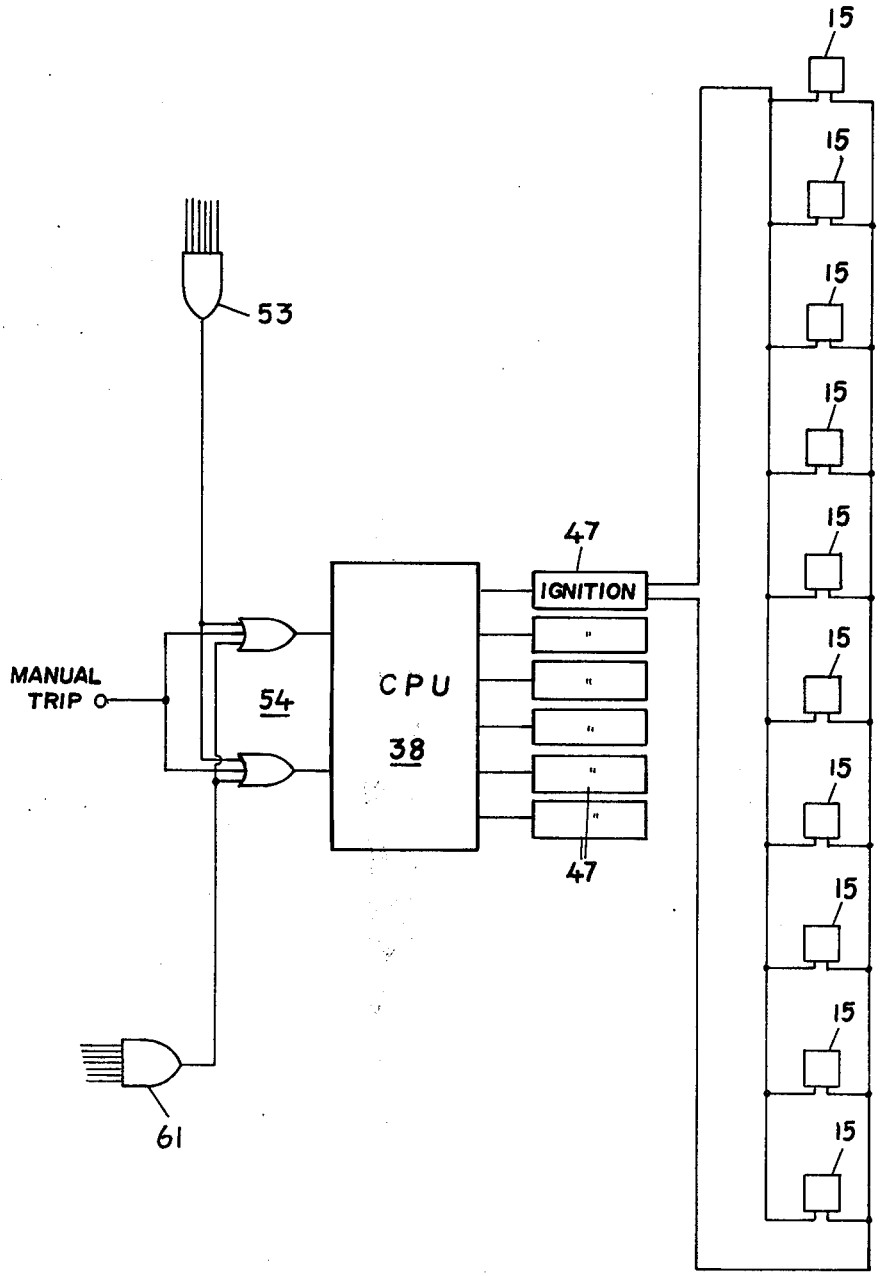
FIG. 10 is a schematic block diagram showing the routing of control signals from the control unit.

FIG. 10 is a schematic diagram showing the OR gates 53, 54 and 61, and the central processing unit 38. Each of the ignition control units 47 controls the ignition of a selected group of burners 15.

The effect of the burners, when ignited, is to produce by thermal convection a strong upward current of air from a base region surrounding the contained area, thereby to form a buoyant plume of rising air. The configuration of this upward current of air is highly dependent upon atmospheric conditions, and in a high wind may take the form of a ragged plume.

Figure 11:
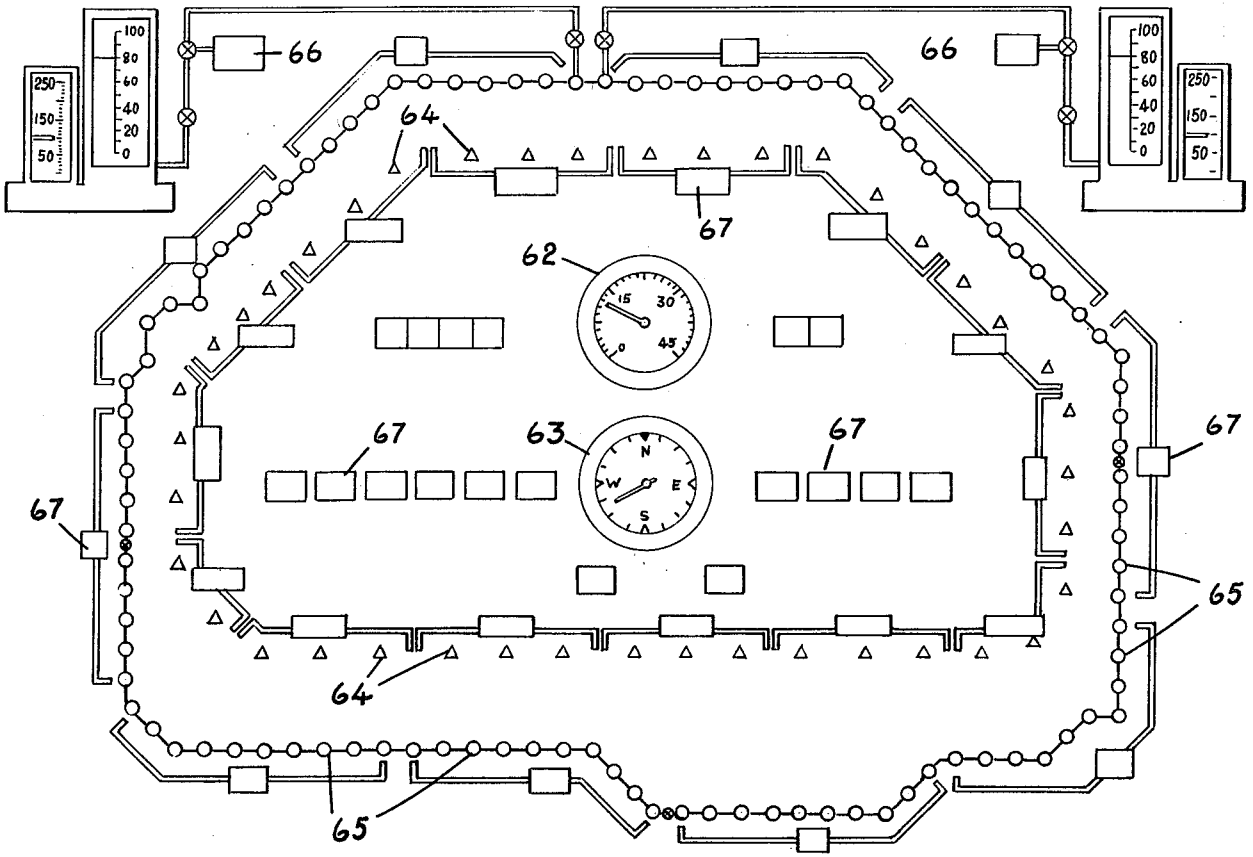
FIG. 11 illustrates a console display panel used in association with the system.

FIG. 11 illustrates a display panel whose display is determined by the central processing unit. The panel provides a mimic layout of the heavy water plant, with a dial 62 providing an indication of wind velocity and a dial 63 providing an indication of wind direction. A first set of indicator lamps 64, located at positions corresponding to the locations of groups of the gas sensor towers, serve to indicate responses from the groups of sensors in accordance with the gas detection by the sensors. A second set of indicator lamps 65, located at positions corresponding to the locations of groups of burners, serve to indicate the operation of the group of burners, in accordance with responses from the flame sensors or ignition current monitors. The lamps 64 are illuminated selectively in groups in accordance with the detection of gas by the sensors of the respective groups; thus, an observer can determine whether the illumination of certain lamps 64, in response to warning signals indicating a gas level at which the burners are not ignited, represents an anomalous condition having regard to the wind direction and velocity.

The display panel also provides a number of other lamps 66, which are illuminated in response to a trip signal from the rate-of-change-of-pressure system on the corresponding process tower. In addition there are provided pilot and indicator lamps 67, the purposes of which are to inform a supervisor of conditions relating to the operability of various components and ancillary features of the system; these lamps and their associated circuits play no part in the functioning of the gas dispersion system in emergency conditions.

What we claim is:

1. In combination with a gas dispersion system for dispersing noxious gas released into the atmosphere within a contained ground area to prevent its passing at an unacceptable concentration to a neighbouring ground area to be protected, the system comprising a plurality of gas sensors distributed along a first base region, the gas sensors being positioned and arranged to intercept the flow of gas from the contained area towards the protected area, circuit means coupled to the gas sensors for producing a trip signal in accordance with the detection of gas thereby, a plurality of burners distributed along a second base region interposed between the first base region and the protected area, the burners being so positioned and arranged so that, when ignited, they produce by thermal convection an air curtain for dispersing the gas upwards, control means responsive to said trip signal, fuel supply means for the burners, and ignition means operable by the control means in response to said trip signal for igniting the burners thereby to produce the air curtain, display means comprising a console display panel and condition-responsive means for producing thereon a display representative of the current condition of the system, the display panel providing a ground plan of the plant, a first set of indicator lamps located at positions on the panel corresponding to the positions of the gas sensors, a second set of indicator lamps located at positions on the panel corresponding to the positions of the burners, and wind direction and velocity indicating means, said condition-responsive means including means responsive to ignition of the burners for illuminating the second set of indicator lamps, and means responsive to said warning signals for illuminating the first set of indicator lamps selectively in accordance with the detection of gas by the corresponding gas sensors of the corresponding groups.

2. A gas dispersion system according to claim 1, wherein the first and second base regions wholly surround the contained area, the first base region being wholly surrounded by the second base region.

3. A gas dispersion system according to claim 1, wherein the gas sensors are mounted on support towers spaced along said first base region, each tower carrying a plurality of gas sensors mounted at different heights.

4. A gas dispersion system for use in association with an industrial plant in which a noxious gas is normally contained under pressure, the system being operable to disperse such gas which may be accidentally released into the atmosphere, so as to prevent its passing at an unacceptable concentration to a neighbouring area to be protected, the system comprising:

pressure monitoring means for monitoring the pressure of the contained gas, circuit means responsive to said pressure monitoring means for producing a first trip signal in accordance with a fall of pressure of the contained gas in excess of a predetermined rate, a plurality of gas sensors wholly surrounding an area of the plant in which the gas is normally contained, the sensors being positioned and arranged to intercept the flow of gas from the contained area towards the protected area, circuit means responsive to said gas sensors for producing a second trip signal in accordance with the detection of gas thereby at a concentration higher than a predetermined level, a plurality of burners distributed along a base region surrounding the gas sensors, the burners being so positioned and arranged that, when ignited, they produce by thermal convection an air curtain for dispersing the gas upwards, control means responsive to said first and second trip signals, fuel supply means for the burners, and ignition means operable by the control means in response to said first or second trip signal for igniting the burners thereby to produce the air curtain.

5. A gas dispersion system according to claim 4, wherein the gas sensors are interconnected in groups, the sensors of each group being distributed along a common segment of the periphery of said area of the plant in which the gas is normally contained, each group of sensors being connected to a respective one of a plurality of warning circuits, each warning circuit being operable to produce a warning signal in response to the detection of gas by the sensors of its associated group at a concentration below said predetermined concentration.

6. In combination with a gas dispersion system according to claim 5, a console display panel and condition-responsive means for producing thereon a display representative of the current condition of the system, the display panel providing a ground plan of the plant, a first set of indicator lamps located at positions on the panel corresponding to the positions of the gas sensors, a second set of indicator lamps located at positions on the panel corresponding to the positions of the burners, and wind direction and velocity indicating means, said condition-responsive means including means responsive to ignition of the burners for illuminating the second set of indicator lamps, and means responsive to said warning signals for illuminating the first set of indicator lamps selectively in groups in accordance with the detection of gas by gas sensors of the corresponding groups.

* * * * *